United States Patent [19]

FitzGibbon et al.

[11] Patent Number: 4,718,194

[45] Date of Patent: Jan. 12, 1988

[54] WINDOW SASH SUPPORT AND MOVEMENT LOCK ASSEMBLY

[75] Inventors: Jack R. FitzGibbon; Lawrence Versteeg, both of Sioux Falls, S. Dak.

[73] Assignee: Balance Systems, Inc., N. Sioux Falls, S. Dak.

[21] Appl. No.: 917,713

[22] Filed: Oct. 10, 1986

[51] Int. Cl.[4] ..... E05D 15/22

[52] U.S. Cl. ..... 49/181; 49/453

[58] Field of Search ..... 49/181, 453; 16/197, 16/193

[56] References Cited

U.S. PATENT DOCUMENTS

| | | | |
|---|---|---|---|
| 3,482,354 | 12/1969 | Trout | 49/181 |
| 4,068,406 | 1/1978 | Wood | 49/181 |
| 4,079,549 | 3/1978 | Wood | 49/181 |
| 4,364,199 | 12/1982 | Johnson et al. | 49/181 |
| 4,590,708 | 5/1986 | Campodonico | 49/181 |

*Primary Examiner*—Philip C. Kannan

*Attorney, Agent, or Firm*—James T. FitzGibbon; Angelo J. Bufalino

[57] ABSTRACT

A window sash support and movement lock assembly reciprocably disposed within an associated track element. The sash support and movement lock assembly includes a body with a center opening and guide surfaces on each end. A cam unit is received in the center opening and, upon cam rotation caused by tilting of an associated window sash, the guide surfaces are biased apart and into snug engagement with parts of the track element; one part of one of the guide surfaces also carries one or more pins which then engage an end wall of the track unit to provide a secure locking action.

21 Claims, 7 Drawing Figures

WINDOW SASH SUPPORT AND MOVEMENT LOCK ASSEMBLY

BACKGROUND OF THE INVENTION

The present invention relates generally to locking devices for window sash, and more particularly, to a locking assembly which enables the balancing forces developed by the sash balance or other counterweight device to be temporarily locked against movement so that the window sash may be removed for cleaning, replacement or repair without altering the position of the sash balance or counterweight mechanism.

Assemblies of this general type are known to the prior art, but the present invention is directed to an improved form of assembly which includes novel features of construction and provides important advantages in operation. In the residential and commercial window field, it is of increasing importance to be able to remove or reposition window sash for cleaning, replacement and repair in a simple and straightforward manner, and in such a way that special equipment or skilled labor is not required.

With the ever increasing cost of maintenance and repair and labor, it is important that a window sash assembly, including one or more window jambs, jamb liners and balance assemblies, be of an integrated design such that the parts cooperate in use to provide the best combination of thermal insulation, low cost and convenience in use and wherein anticipated maintenance and repair costs are also low.

By way of background, the tendency of a window sash to fall by gravity to a lowered position, i.e., either closed or open, depending on whether it is an upper or a lower sash, is counteracted by some sort of balancing device. In the simpler systems, one or more springs are provided to offset a portion of the weight and the remainder of the "balancing" is accomplished in a relatively crude, but sometimes sufficiently effective way by providing sufficient engaging friction with the jamb or jamb liner to prevent the window sash from simply assuming a neutral position at which point the spring return forces exactly balance the weight load of the sash.

In more sophisticated systems, devices including block and tackle assemblies provide a combination of the necessary internal friction and mechanical advantage such that a relatively limited movement of the balance assembly provides a much larger range of movement of the sash itself, with springs also being included in these assemblies so as to provide the lifting or weight-offsetting force. In such constructions, the tendency of the sash to assume a single position is much more easily overcome, and a range of balancing forces readily permitting the window to remain balanced through a range of positions from fully open to fully closed is provided.

In the prior art, means of locking in place the window hardware affixed to the movable end of the balance assembly are also known, but these systems have suffered from one or more drawbacks, and are otherwise capable of improvement in use. The present invention is particularly concerned with a form of assembly directed to this end, and particularly to a construction wherein a sash support and movement lock assembly may be utilized successfully with an associated jamb liner extrusion of a single design, regardless of whether a more sophisticated sash balance is used, or simple balancing springs only are provided. The assembly of the invention includes a support for a sash mounting pivot which, upon limited rotation, actuates a cam which secures the lock and enables the sash to be removed while the lock and balance remain in place.

According to the invention, an adjustable friction brake element is also provided in the lock assembly which renders it adaptable for use with the simple spring-type balance. In this way, the amount of frictional drag intended to be imparted to the sash may be adjusted independently of the force required to lock the support assembly in place, and also independently of friction developed by the fit of the sash with the jamb liner. An undesirably tight fit or close interference between the dimensions of the facing parts respectively of the jamb liner and the window sash edges and/or weather stripping to create friction can undesirably cause increased wear, and moreover, such friction depends on the fit between separately manufactured parts and may thus be difficult to control.

In view of the failure of the prior art to provide a versatile support and lock assembly having the foregoing advantages and characteristics, and others which are inherent in the invention, it is an object of the invention to provide an improved sash support and lock assembly for tilt out or tilt-and take out window sash and their associated components.

Another object of the invention is to provide a lock assembly for the foregoing purpose which is adaptable, without significant change, for use with either the block and tackle or internal friction type true balance assembly or the simple spring balance assembly, without significant change to the lock assembly.

Still another object of the invention is to provide a lock for take out sash which permits the sash designer to specify a single type of jamb liner extrusion and to supply this as a component for use with the associated window sash, regardless of the type or style of balance specified.

Yet another object of the invention is to provide a window sash support and movement lock assembly, which includes a body having a pair of guide elements forming a part thereof, and in which at least one of the guide elements includes a tapered end face surface portion receiving a locking pin, and wherein the body is capable of being cammed into a spread-apart or extended position wherein the locking pin engages a part of an associated channel to secure the assembly against movement.

Another object of the invention is to provide a sash support and movement lock wherein an auxiliary friction adjustment device is provided so that the sliding friction of the assembly within the guide track may be controlled as desired.

Another object of the invention is to provide a sash support and movement block assembly which is easy to manufacture at low cost and which may be reliably assembled with minimum labor before use.

A still further object of the invention is to provide a sash support and movement lock assembly for a window sash wherein a unitary body of generally U-shaped cross section is provided and which body includes a cam-receiving opening, surfaces forming a part of that opening for engaging a rotary cam adapted to spread the body apart so that one portion of one of the guide elements forming a part of the body will approach and engage an associated channel to lock the assembly against vertical movement so the sash may be removed and replaced.

A further object of the invention is to provide a window sash support and movement lock assembly which is capable of use as both a left hand and a right hand part so as to reduce the number of parts required in inventory and user application.

Another object of the invention is to provide a sash support and movement lock assembly wherein the body and the cam cooperate in such a manner that only when the cam is in a locked position of the assembly may the window sash be removed.

Another object of the invention is to provide a movement lock and sash support assembly wherein the components are made from inexpensive materials but which has a very extended anticipated life in use.

A still further object of the invention is to provide a sash support and movement lock assembly which, without change, is adaptable for being supported by a sash cord forming a part of a balance assembly or by the hook of a balance spring only, which spring engaged a wire-formed spring holder in use.

The foregoing and other objects and advantages of the invention are achieved in practice by providing a sash support and movement lock assembly which includes a body having a structure connecting opposed guide elements, at least one of which carries a locking pin and which may be biased by a cam mechanism into engagement with one wall of the channel guiding the movement of the assembly in use, and in which the body moves between an extended or locked position tilted out and returns to a withdrawn position when the window sash is inserted and tilted to an upright position of use within an associated window jamb.

The manner in which the foregoing and other objects and advantages of the invention are achieved in practice will become more clearly apparent when reference is made to the following detailed description of the preferred embodiments of the invention set forth by way of example and shown in the accompanying drawings, in which like reference numbers indicate corresponding parts throughout.

DESCRIPTION OF THE PREFERRED EMBODIMENTS OF THE INVENTION

While the sash support and movement lock assembly of the invention may be combined with various types of window sash, and in fact with other balanceable, vertically movable structures, a detailed description of the construction and operation of two embodiments of the invention will be given, both of which are directed to a tilt and/or tilt and take-out window sash arrangement.

Figure 1:
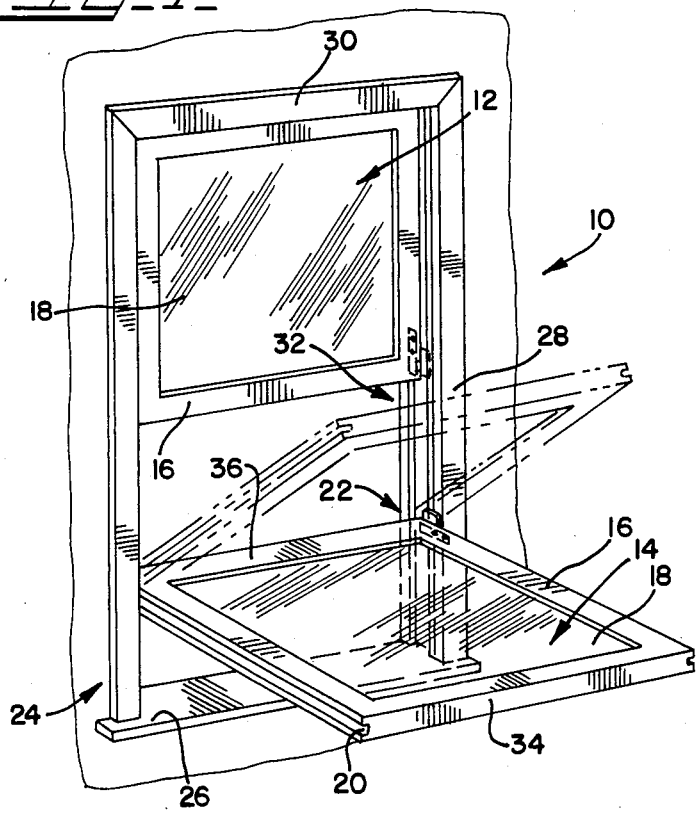
FIG. 1 is a perspective view of a window assembly showing a tilt-out type of sash in a pre-removal position wherein the sash support and movement lock assemblies of the invention are locked in position against the lifting forces applied by the balance.

Referring now to the drawings in greater detail, in FIG. 1, the invention is shown to be embodied in and form a part of a window assembly generally designated 10 and shown to include an upper window sash assembly generally designated 12 and a lower sash assembly generally designated 14. Each sash 12, 14, includes a peripheral frame element 16 and a glass light on window pane 18. The sash shown are of conventional construction for double-hung windows and each includes, in addition to the parts just referred to a rabbeted or cut-out guide slot 20 extending, in position of use, vertically along either side of the sash frame 16.

The sash support and movement lock assembly, generally designated 22 in FIG. 1, are provided in mirror image pairs, (of which only one is shown in FIG. 1) and these assemblies are adapted to lock the sash balance against movement when an associated sash such as the sash 14 is positioned for removal as shown in FIG. 1.

In this connection, it will be understood that the window assembly 10 also conventionally includes a window jamb assembly generally designated 24 and shown to include a sill 26, vertical stiles 28 or the like and a top header 30. Each window also includes a jamb liner assembly generally designated 32 and shown somewhat schematically, but as is well-known to those skilled in the art, such liner 32 customarily includes interior tracks or channels each containing a balance and a movement lock assembly. The liner 32 also includes a portion adapted for cooperation with the guide slot 20, thus helping guide and locate the window for vertical movement. The liner may also serve as weather strip for the window sash.

In the construction shown in FIG. 1, it will be assumed that it was desired to remove the lower sash 14 for cleaning, replacement, or repair. For this purpose, the sash is positioned with its lower frame element 36 several inches above its downward-most or closed position, and the weather stripping forming a part of the jamb liner is moved aside slightly as the window sash as a whole is tilted outwardly with its top rail 34 moved downwardly in an arc as shown.

At this point, when the sash is approximately horizontal, the sash support and movement lock assembly 22 of the invention is positioned in such a way that the window is able to be removed by an upward lifting and pivoting movement of the lower frame element 36, also as shown. Such tilt and take-out action is known to those skilled in the art, and a further description thereof is not believed necessary to a full understanding the invention.

Figure 2:
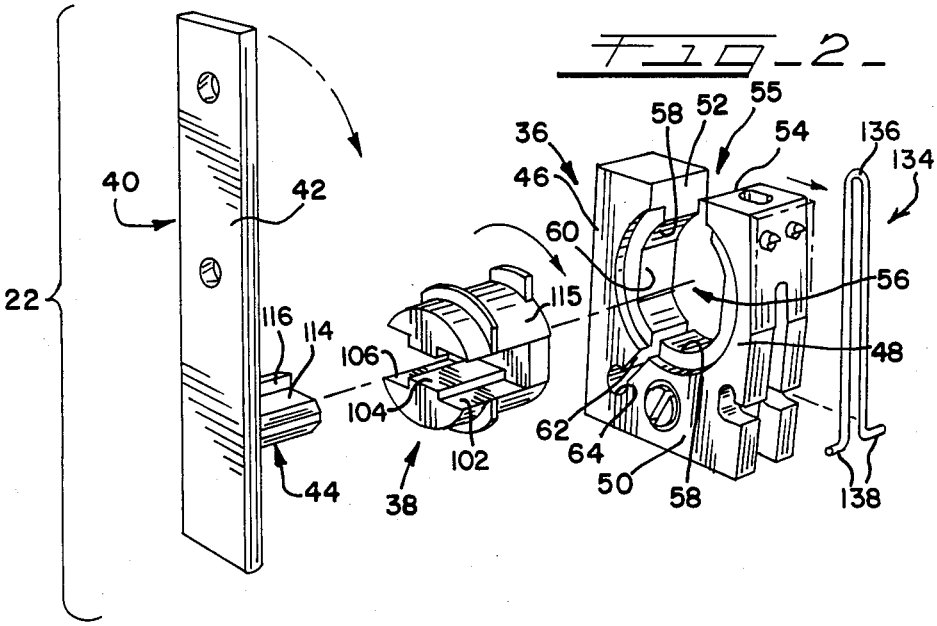
FIG. 2 is an enlarged exploded perspective view showing the principal elements of the sash support and movement lock assembly, including the locking body, the sash mounting pivot, and the cam element.
Figure 4:
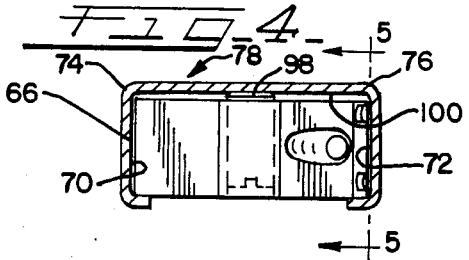
FIG. 4 is a top plan view of the body of FIG. 3, showing the same in position of use within an associated guide track which is shown in cross-section.
Figure 5:
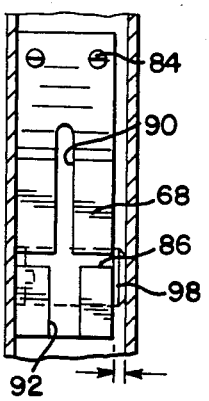
FIG. 5 is a view, partly in elevation and partly in section, taken along lines 5—5 of FIG. 4 and showing the locking body in position of use within the guide track and showing the friction adjustment thereof.

Referring now to FIG. 2, certain constructional details of the novel sash support and movement lock assembly are shown. Here, and in FIGS. 3-5, the assembly is shown to include a locking body generally designated 36, a cam element generally designated 38, and a means in the form of an actuator generally designated 40 for the lock assembly 10 and shown to include a mounting plate 42 and a mounting pivot support stud generally designated 44.

Referring again to the locking body 36, in the preferred form shown, this unit includes integrally formed inner and outer guide elements 46, 48, secured to each other by a connecting structure 50. In a preferred form, this unit is made from a somewhat resilient thermoplastic material, preferably by injection molding. Each guide element 46, 48 includes an associated inner end wall 52, 54 which walls are spaced apart to form a slot 55 for receiving the stud 44. The body 36 also includes a cam-receiving opening generally designated 56 and shown to include a sidewall having a plurality of circular profile sections 58 and a pair of opposed, flattened cam engaging surfaces 60. A slot 62 terminating in a small, circular strain relief opening, 64 is provided to separate a portion of one guide 46 from the remainder of the connecting body 50 and the other guide 48. This allows, as will appear, the body to be spread apart and permits movement of the guide elements 48, 50 to take place relative to each other.

Figure 3:
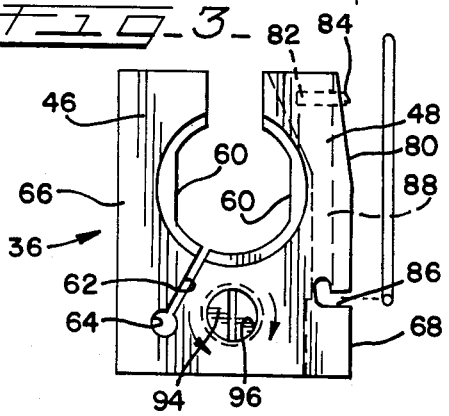
FIG. 3 is a side elevational view of the body portion of the lock assembly of FIG. 2, showing the optional wire form type spring support clip spaced apart from the body.

Referring to FIGS. 3, it is shown that each guide element 46, 48 also includes a generally planar, first outer end face surface 66, 68. These surfaces lie in parallel planes and are adapted to be spaced by a working clearance from the opposed inner walls 70 72 of the channel portions, 74, 76 of a guide track generally designated 78 in which the assembly as a whole slides in use. This track 78 customarily forms a portion of the jamb liner assembly 32 shown in FIG. 1 and described above. The maximum width of the body 36 when it is in a relaxed or retracted condition is defined by the space between the planes of these end face surfaces 66, 68.

An important feature of the invention is the provision of at least one second or auxiliary exterior end face surface 80 on at least one guide element 48 of the body 36. This auxiliary surface 80 is disposed above the guide surface 68 which forms a part of the body 36, and which is slightly inclined so as to lie inwardly of the maximum width of the body 36. Adjacent the upper end of the auxiliary surface 80 and thus carried by the guide 48 are a pair of identical locking pins 82, each of which includes a sharpened, locking end portion 84.

The body 36 also includes a contoured sidewall defining a key slot 86 of generally L-shaped profile in elevation and communicating along its interior surfaces with a vertically extending passage 88 for receiving a sash cord or a spring hanger clip. An upper vertical slot 90 (FIG. 5) is provided to help position a wireform spring hanger, and a lower vertical slot 92 is also provided in the body 36 to help assemble the unit with the sash cord of an associated balance. These slots provide alternative methods for attachment of the balancing force unit with which the assembly will be associated in use.

FIGS. 2-5 also show another feature of the invention, namely, a friction-adjusting screw 94 which is disposed in a threaded bore 96 forming a part of the body 36, with the screw 94 including a force-applying, generally flat end face 98. In use, the screw is rotated, its end face 98 will engage the end wall 100 of the guide track 78 to create frictional resistance to sliding of the body 36, and thus provide controlled resistance its movement.

Referring again to FIG. 2, the cam element 38 is shown in detail to include offset upper and lower sidewalls 102, 104, 106, 108, 110, 112, defining slots for receiving the shank portion 114 of the stud 44.

Figure 6:
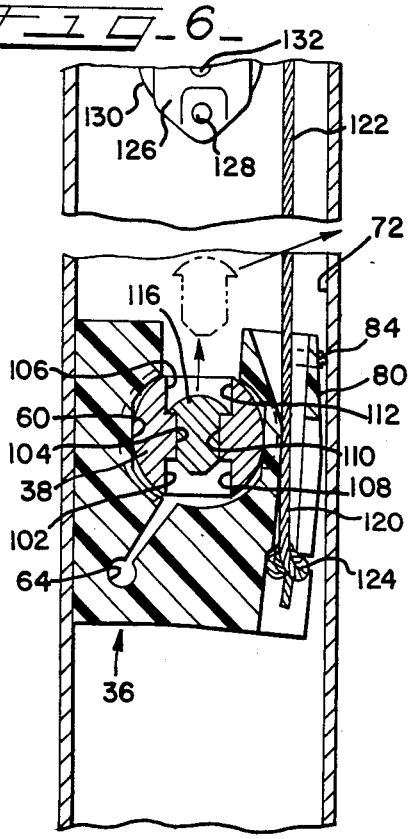
FIG. 6 is a vertical sectional view of the sash support and movement lock assembly of the invention in an extended and locked position of use, illustrating the manner in which the sash pivot may be removed and illustrating the device as associated with a conventional block and tackle balance unit.
Figure 7:
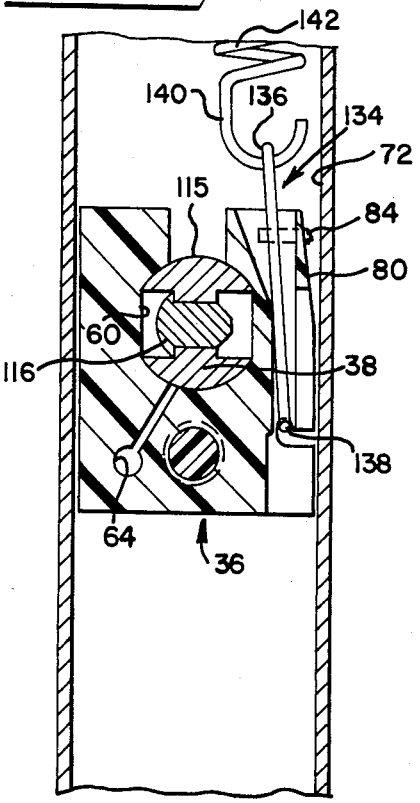
FIG. 7 is a vertical sectional view somewhat similar to that of FIG. 6, but showing the assembly in an unlocked position of use, being utilized in association with a balance spring only, and further including the adjustable friction lock feature.

As is also shown in FIG. 2, the cam element 38 includes a generally cylindrical actuating surface 115. Referring to FIGS. 6 and 7, the use of two forms of the assembly is shown. FIG. 6 shows the unit 10 being used with a block and tackle type window sash balance. This balance is of a kind known to those skilled in the art, and is shown and described for example in U.S. Pat. No. 4,089,085. In FIG. 6, the lower end 120 of a sash cord 122 extends through the passage 88 and is retained therein by a knot 124. The cord 127 is trained in several loops over an upper and lower pulley assembly forming part of the balance. In FIG. 6, the balance is shown to include a lower pulley block 126, retained by a pin 128; the lower pulley 130 is held in the block 126 by an axle 132.

It is understood that one of the pulley blocks in the balance assembly moves up and down and the other remains fixed as the window sash 14 travels, but as is known to those skilled in the art, the travel of the movable pulley block (not shown) is a small fraction (usually ¼ or 1/5) of the travel of the sash and the sash support and movement lock assembly. The pulley block assembly and the remaining elements of the sash balance are preferably located within the guide track 78 but may be located elsewhere.

FIG. 6 shows that rotation of the stud 44 moves the body 36 into an extended and hence locked position. Where the body is a one-piece plastic unit, its own innate resiliency returns it to the retracted position when the cam element rotates back to a position wherein the sash is vertical. Another feature shown in FIG. 6 is that, in use, the shank portion 114 of the stud 44 is located such that its sides are in registry with the center slot surfaces 104, 110 of the cam element 38, and the enlarged head portion 116 faces upwardly and is slidingly received in the slot formed by the opposed surfaces 102, 108 in the cam element 38. In this position, therefore, as shown in phantom lines, the stud 44 and the sash 14 may be removed upwardly through the slot 55 in the body 66. The phantom line arrows in FIG. 6 show the first vertical removal, and then the pullout or partially horizontal removal of the window sash 14 after the cam 38 has been rotated within the body 36 to the position shown in FIG. 6. When this action occurs, the cylindrical surfaces 115 on the cam element 38 have also engaged the actuating or counterpart cam surfaces 60 partially defining the cam-receiving opening 56 in the body 36. This causes the wedging action shown, and the entire right side of the assembly, including the guide element 48 and the connecting portion 50 deflect somewhat as a unit about the virtual point defined by the strain relief surface 64. This permits the auxiliary or second, inclined surface 80 to lie parallel to and engage or be spaced just apart from the surface 72 of the channel forming a part of the guide track 78. In this position, the end portions 84 of the pins 82 lock tightly against the channel surface 72 and positively prevent any relative movement of the sash support.

Referring now to FIG. 6, a construction is shown wherein a body 36 is in its relaxed or as-molded condition, i.e., its retracted position as regards the auxiliary end face surface 80. In this embodiment, the friction adjusting screw 94 is shown to be received in the threaded bore 96 of the body 36. The vertically extending passage 88 in this case receives a spring clip also FIGS. 2 and 3) generally designated 134 and including a bight or closed loop portion 136 at its upper end and a pair of oppositely directed legs 138 at the bottom thereof. The hook portion 140 of a spring 142 extends through the bight or eye 136 of the clip to secure the body 36 to the means, in this case the balance spring, for applying the counterbalancing force to the window sash.

Referring now to more general features of the invention, the body 36 is preferably made in a single piece by injection molding from a filled or non-filled thermoplastic material. The body could, of course, be formed from other materials and could conceivably be made in two or more pieces; however, in the simple form shown, the movement between extended and retracted positions is facilitated by the innate resiliency of the thermoplastic material and it is not necessary to provide a separate hinge no to make the body in two or more parts for this purpose. Providing the auxiliary inclined surface 80 at the narrow included angle helps spread the frictional force developed between the locking pins and the surface 80. The pins are preferably stainless steel, which is relatively hard; the sharp points 84 are imparted to the pins 82 by the cutting off process. The cam is preferably a die-cast metal material. Where the slot 55 is provided between the opposed inner end face surfaces 52, 54, and the cam as made as shown, the upwardly opening slots register to permit removal of the stud and hence the window. In certain cases, this may not be necessary or desirable and alternative arrangements may be made to prevent free removal of the stud or other sash pivot from the cam. The body unit of the invention may be made symmetrical or reversed simply by utilizing it in the other end of the track, in which case the pins would engage opposite surfaces of the channel. If not, the pair of locks may both be placed in the orientation of FIG. 2 and the cam may be inserted from the other side. Hence, the unit need not be manufactured in left and right hand elements in order for the parts to be operable at both sides of the sash.

Another feature of the invention is the shouldered slots provided in the cam. This enables the head 116 of the stud 44 to be precisely positioned with respect to the cam.

In use, the sash support and locking assembly of the invention has proved very advantageous over prior art designs requiring additional parts or featuring less reliable locking assemblies. The provision of the optional friction lock makes it possible to achieve better control of friction than would otherwise be available to the designer. The addition of the friction screw element to the lock assembly is a simple matter and adds only a few cents or less to the cost of each unit. However, because of the type of friction action provided, the use of this auxiliary screw does not require alteration of the remaining parts of the lock assembly. Hence, the hardware supplier need not make different designs for parts which are similar except for the style or type of balance used.

It will thus be seen that the present invention provides an improved sash support and lock assembly having a number of advantages and characteristics, including those pointed out herein and others which are inherent in the invention. Two preferred embodiments having been shown by way of example, it is anticipated that modifications and variations to the disclosed forms of lock units will occur to those skilled in the art and it is anticipated that such changes and modifications may be made without departing from the spirit of the invention or the scope of the appended claims.

We claim:

1. A window sash support and movement lock assembly, said assembly comprising, in combination, a pair of opposed guide elements and a connecting structure extending between and joining portions of said guide elements together to form a guide element body, said body permitting deflection of at least parts of said guide elements relative to each other as said body is moved between extended and retracted positions, said body further having generally radially inwardly directed surfaces defining an opening for receiving a cam element, said sash support and movement lock assembly being adapted to move reciprocably with its guide elements being received generally within oppositely disposed channels forming parts of an associated guide track for said sash support and movement lock assembly, each of said guide elements having a first end face surface adapted to be positioned in opposed facing relation to a respective one of the walls of said associated guide track channel and spaced apart by a working clearance from said one wall, with said first end face surfaces of said guide elements lying in generally parallel planes defining therebetween the maximum width of said body in its retracted position, at least one of said guide elements also including an auxiliary end face surface which is slightly inclined inwardly of said body maximum width, at least one locking pin carried by the portion of said guide element which includes said auxiliary end face surface, said auxiliary end face surface and said pin being arranged such that when said body is in its retracted position, said pin lies entirely within said body maximum width, a cam element disposed in said cam receiving opening, and having a pivot axis extending axially therethrough, said cam element including means for receiving a window sash mounting pivot, said cam element and said cam receiving opening being constructed and arranged so that, upon movement of said cam element about said pivot axis, said body moves from said retracted position to said extended position, in which at least a portion of said pin carried by said guide element lies outside plane of said guide element first end face surface when said body is in its retracted position.

2. A sash support and movement lock assembly as defined in claim 1 wherein said body is a unitary body made from a resilient thermoplastic material.

3. A sash support and movement lock assembly as defined in claim 1 wherein said movement of said body form said retracted position to said extended position is resisted by the inherent resiliency of said unitary thermoplastic body material.

4. A sash support and movement lock assembly as defined in claim 1 wherein generally radially inwardly directed surfaces defining said cam-receiving opening include a pair of spaced apart end portions defining therebetween a portion of an upwardly open slot, the remainder of said slot being defined by endwall surfaces, whereby said slot is adapted to permit passage of said sash mounting pivot though said body to said cam element.

5. A sash support and movement lock assembly as defined in claim 1 wherein the length of said auxiliary end face surface is approximately equal to the length of said first end face surface which comprise the remainder of said one end of said body.

6. A sash support and movement lock assembly as defined in claim 1 wherein said at least one locking pin comprises two locking pins, said pins having sharpened end points to facilitate positive engagement with said associated guide track channel.

7. A sash support and movement lock assembly as defined in claim 1 wherein said at least one locking pin comprises two locking pins, said pins lying adjacent the upper end of said auxiliary end face surface.

8. A sash support and movement lock assembly as defined in claim 1 wherein said cam element is made from a metal or metal alloy material.

9. A sash support and movement lock assembly as defined in claim 1 wherein said cam element is of generally cylindrical shape and includes a pair of generally cylindrical surfaces, said surfaces being spaced apart by a shouldered slot extending transversely through the body of said cam, said slot being thereby adapted to receive said sash mounting pivot entirely within the body of said cam element.

10. A sash support and movement lock assembly as defined in claim 1 wherein said cam element is generally cylindrical, includes a pair of cylindrical surfaces spaced apart by a transverse slot, and wherein at least two of said inwardly directed surfaces in said body include opposed flat sidewall portions extending chordwise across portions of said surface defining said cam-receiving opening.

11. A sash support and movement lock assembly as defined in claim 1 wherein said connecting structure forming a part of said body is spaced apart from one of said guide elements by a slot having one open end communicating with said cam receiving opening in said body.

12. A sash support and movement lock assembly as defined in claim 11 wherein said slot separating said connecting structure and one of said guide elements from the other of said guide elements includes an enlarged closed end portion of smooth radius to increase the resistance of said body to damage by stress concentrations resulting from deflection of said body.

13. A sash support and movement lock assembly as defined in claim 11 wherein said body further includes a tapped opening and an adjustment screw positioned therein, said adjustment screw having means forming a part thereof for engaging face of said guide track to provide controlled resistance to movement of said sash support and movement lock assembly.

14. A sash support and movement lock assembly as defined in claim 13 wherein said tapped opening is disposed within said connecting structure portion of said body.

15. A sash support and movement lock assembly as defined in claim 1 wherein said body includes a generally vertically extending passage formed in one of said guide elements, said passage being adapted to facilitate attachment between the sash cord forming a part of an associated balance and said body of said sash support and movement lock assembly.

16. A sash support and movement lock assembly as defined in claim 15 wherein said vertically extending passage is adapted to receive a clip unit for attachment to the movable end portion of an associated sash balancing spring.

17. A sash support and movement lock assembly as defined in claim 1 wherein said cam element and said guide element body are constructed and arranged to permit removable reception of said sash mounting pivot in said cam element.

18. In combination, a window and window jamb assembly including a jamb having guide tracks for at least one vertically reciprocable window sash, a sash having a tilt mechanism which includes a mounting plate with means forming a mounting pivot extending outwardly from said plate and adapted to be received in an associated sash support and movement lock assembly, a pair of sash support and movement lock assemblies each comprising a body, having a pair of opposed guide elements and a connecting structure extending between and joining portions of said guide elements together, each of said bodies permitting deflection of at least parts of said guide elements relative to each other as said body is moved between extended and retracted positions, each of said bodies further having a generally radially inwardly directed surface defining an opening for receiving a cam element, each of said support and movement lock assemblies being movable reciprocably with said guide elements being received generally within oppositely disposed channels forming parts of each of said associated guide tracks for said sash, each of said guide elements having a first end face surface adapted to be positioned in opposed facing relation to a respective one of said channel walls and spaced apart from said channel walls by a working clearance, with said first end face surfaces of each of said guide elements lying in generally parallel planes defining therebetween the maximum width of each of said bodies in its retracted condition, at least one of each of said guide elements also including an auxiliary end face surface which is slightly inclined inwardly of said body maximum width, at least one locking pin carried by the portion of said guide element which includes said auxiliary end face surface, said surface and pin being arranged such that when said guide elements are in their retracted positions, said pin lies entirely within said maximum width, a cam element pivotably disposed in each of said cam receiving openings, said cam element receiving and supporting said sash mounting pivot with said cam element and said cam receiving openings in unitary bodies being constructed and arranged so that, upon tilting movement of sash, said cam elements pivot and to move each of said guide elements carrying said pin from said retracted position to said extended position, whereby at least a portion of each of said pins engages said one wall of said associated guide track channel to secure said support and movement lock in place with respect to said window jamb.

19. A sash support movement and lock assembly as defined in claim 18 where said guide tracks for said sash and said guide for said lock assembly comprise parts of a single jamb liner assembly.

20. A combination as defined in claim 18 wherein said at least one window sash includes two window sash.

21. A window and window jamb assembly as defined in claim 18 wherein said cam elements, said mounting pivots, and said bodies are constructed and arranged such that said sash may be removed from said bodies when said bodies are secured against movement within said channels.

* * * * *